US009581933B2

(12) United States Patent
Kase et al.

(10) Patent No.: US 9,581,933 B2
(45) Date of Patent: Feb. 28, 2017

(54) REGULATING MEMBER, DEVELOPING DEVICE AND PROCESS CARTRIDGE

(71) Applicant: CANON KABUSHIKI KAISHA, Tokyo (JP)

(72) Inventors: Takashi Kase, Tokyo (JP); Hideaki Hasegawa, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/594,401

(22) Filed: Jan. 12, 2015

(65) Prior Publication Data

US 2015/0132029 A1 May 14, 2015

Related U.S. Application Data

(62) Division of application No. 13/474,840, filed on May 18, 2012, now Pat. No. 8,948,665.

(30) Foreign Application Priority Data

May 25, 2011 (JP) ..... 2011-116867
Apr. 17, 2012 (JP) ..... 2012-093539

(51) Int. Cl.
*G03G 15/08* (2006.01)

(52) U.S. Cl.
CPC ..... *G03G 15/0812* (2013.01)

(58) Field of Classification Search
CPC ..... G03G 15/0812; G03G 15/0818; G03G 15/0808; G03G 15/081; G03G 15/0817
USPC ..... 399/284
See application file for complete search history.

(56) References Cited

U.S. PATENT DOCUMENTS

| | | | | |
|---|---|---|---|---|
| 5,110,705 | A | 5/1992 | Hosoya | |
| 6,604,399 | B1 * | 8/2003 | Yoshida et al. | 72/326 |
| 6,947,678 | B2 | 9/2005 | Ohtomo et al. | |
| 6,963,714 | B2 | 11/2005 | Otomo et al. | |
| 7,215,904 | B2 | 5/2007 | Hasegawa et al. | |
| 7,460,798 | B2 | 12/2008 | Toda et al. | |
| 7,639,956 | B2 | 12/2009 | Naito et al. | |

(Continued)

FOREIGN PATENT DOCUMENTS

| | | |
|---|---|---|
| JP | 2001-109259 | 4/2001 |
| JP | 2009-288817 | 12/2009 |
| JP | 2011-194609 | 10/2011 |

OTHER PUBLICATIONS

Machine translation of Namiki JP 2001-109259 A, publication date: Apr. 20, 2001.*

(Continued)

*Primary Examiner* — Walter L Lindsay, Jr.
*Assistant Examiner* — Frederick Wenderoth
(74) *Attorney, Agent, or Firm* — Fitzpatrick, Cella, Harper & Scinto

(57) ABSTRACT

A regulating member for regulating a developer amount carried on a developer carrying member includes a plate-like supporting member having an elasticity, the supporting member being provided with a fixed portion for being fixed to a fixed part; a first contact portion contactable to the developer carrying member, the first contact portion protruding from the regulating member from a side of the supporting member; and a second contact portion contactable to and the developer carrying member, the second contact portion being at a position closer to the fixed portion than the first contact portion.

10 Claims, 10 Drawing Sheets

(56) References Cited

U.S. PATENT DOCUMENTS

| | | | | |
|---|---|---|---|---|
| 7,692,804 | B2 | 4/2010 | Naito et al. | |
| 8,036,544 | B2 | 10/2011 | Toda et al. | |
| 2007/0297834 | A1* | 12/2007 | Nishida et al. | 399/284 |
| 2009/0226205 | A1* | 9/2009 | Sato et al. | 399/101 |

OTHER PUBLICATIONS

Office Action in Chinese Patent Application No. 201210165952.X, dated Apr. 3, 2014 (with English translation).
Office Action in Chinese Patent Application No. 201210165952.X, dated Feb. 2, 2015 (with English translation).

* cited by examiner (a)

(b)

(a)

| OD. DIFF. | EMB. 1 | COMP.(STRAT) |
|---|---|---|
| 12 μm | NO. | NO. |
| 21 μm | NO. | NO. |
| 27 μm | NO. | NO. |
| 41 μm | NO. | THICK |
| 56 μm | NO. | THICK |
| 82 μm | NO. | THICK |

(b)

(a)

(b)

(a)

| OD. DIFF. | EMB. 2 | .COMP.(STRAT) |
|---|---|---|
| 9 μm | NO. | NO. |
| 16 μm | NO. | NO. |
| 24 μm | NO. | NO. |
| 38 μm | NO. | THICK |
| 56 μm | NO. | THICK |
| 79 μm | NO. | THICK |

(b)

(a)

(b)

REGULATING MEMBER, DEVELOPING DEVICE AND PROCESS CARTRIDGE

FIELD OF THE INVENTION AND RELATED ART

The present invention relates to a regulating member for regulating an amount of a developer carried on a developer carrying member, and a developing device provided with the regulating member, and a process cartridge provided with the regulating member.

In a known image forming apparatus, an electrostatic latent image formed on the surface of an image bearing member is developed with a developer carried on the developer carrying member, wherein the developer amount on the surface of the developer carrying member is regulated by the regulating member. In such a structure, the developer amount on the surface of the developer carrying member may be non-uniformity due to a state of contact of the regulating member to the developer carrying member and due to a pressing force of the contact with the result of density non-uniformity or the like. The reasons of the change in the developer amount due to the contact state and the pressing force will be described.

FIG. 10 is a sectional view illustrating a structure of a regulating member 204 and a developing roller 2 in a conventional developing device. As shown in FIG. 10, between the regulating member 204 and the developing roller 2, there is provided a developer intake opening 11. It is known that the developer amount is influenced strongly by a size of the developer intake opening 11. More particularly, when the developer intake opening 11 is large, the developer amount is also large, and when the developer intake opening 11 is small, the developer amount is also small.

Here, the developer intake opening 11 will be described in detail. The developer intake opening 11 is an opening having a substantially triangular shape region defined by the regulating member 204 and the developing roller 2. The height of the triangular shape is the effective developer intake height determined by the developer amount supplied by a supplying roller and carried by the developing roller 2. The bottom side of the triangular shape is a distance x from a position where a distance between the regulating member 204 and the developing roller 2 is the effective developer intake height y and a position where the regulating member 204 contacts the developing roller 2. Thus, when the effective developer intake height y is high, the developer amount is large, and when the effective developer intake height y low, the developer amount is small. Therefore, the developer amount is influenced strongly by the contact state of the regulating member 204 which is a factor determining the size of the developer intake opening 11.

The developer amount is determined by pressing force of the regulating member 204, particularly the maximum value (peak value) of the pressing force. This is because the developer layer passes through the gap between the developing roller 2 which the developer layer contacts and the regulating member 204, and therefore, a width of the gap width is dependent upon the peak value of the pressing force.

For the regulating member 204, a plate spring member cantilevered at the base side thereof and contacted to the developing roller 2 at the free end thereof, is used widely. A position of the free end of the regulating member 204 is so set as to be in the developing roller 2 if the developing roller 2 did not exist, that is, the free end bite into the developing roller 2, and therefore, the free end of the regulating member 204 is deformed by the contact to the developing roller 2, and the pressing force is produced as a repelling force. The pressing force is determined by a free length of the regulating member 204, a thickness thereof, a Young's modulus thereof, the difference between the position of the free end in contact with the developing roller 2 and the setting position of the free end when the regulating member 204 does not contact the developing roller 2.

The regulating member 204 is ordinarily made of a rubber plate, a metal plate, a resin material plate or a laminated member including these materials. As from the cross-sectional configuration thereof, a plate-like or a configuration provided by bending the free end portion into an L-shape is widely used. The developer layer after the regulation is desirably a thin layer from the standpoint of evenness of the charge. For this reason, the free end of the regulating member 204 is made an edge to establish an edge contact state to reduce the developer intake opening 11, thus formation the thin layer.

However, with such an edge contact of the regulating member 204, the contact state and/or the pressing force of the regulating member 204 tends to vary. Therefore, in the case, for example, that an outer diameter of the developing roller 2 varies along a circumferential direction thereof, the contact state of the regulating member 204 and/or the pressing force, and therefore, a cyclic density non-uniformity occurs. In order to stabilize the developer amount on the surface of the developing roller 2 at a target, high accuracy of the free end position is required, which leads to a difficulty in the assembling.

In order to solve such a problem, Japanese Laid-open Patent Application 2009-288817 discloses a regulating member having a curvature shape which is convex toward the developing roller. With such a structure, the regulating member is deformed such that a local maximum value occurs at two positions, by which the peak value of the pressing force is stabilized even if the accuracy of the mounting position is not high.

However, in Japanese Laid-open Patent Application 2009-28881, the developer amount carried on the developer carrying member may not be stabilized when the outer diameter of the developer carrying member varies in the rotational moving direction of the developer carrying member or when the position of the regulating member relative to the developer carrying member varies. An image formed with such conditions may involve the density non-uniformity.

SUMMARY OF THE INVENTION

Accordingly, it is an object of the present invention to provide a regulating member, a developing device and a process cartridge with which the peak value of the pressing force applied by the regulating member to the developer carrying member is stabilized, by which occurrences of the density non-uniformity of the density in the image is suppressed.

According to an aspect of the present invention, there is provided a regulating member for regulating a developer amount carried on a developer carrying member, said regulating member comprising a plate-like supporting member having an elasticity, said supporting member being provided with a fixed portion for being fixed to a fixed part; a first contact portion contactable to the developer carrying member, said first contact portion protruding from said regulating member from a side of said supporting member; and a second contact portion contactable to and the developer carrying member, said second contact portion being at a position closer to said fixed portion than said first contact portion.

According to another aspect of the present invention, there is provided a developing apparatus for developing an electrostatic latent image formed on an image bearing member, said developing device comprising a developer carrying member for carrying a developer for developing the electrostatic latent image; and a regulating member for regulating a developer amount carried on said developer carrying member; said regulating member including, a plate-like supporting member having an elasticity, said supporting member being provided with a fixed portion for being fixed to a fixed part, said supporting member has a free end disposed at an upstream side with respect to a rotational moving direction of said developer carrying member; a first contact portion provided on said supporting member and protruding toward said developer carrying member to contact to said developer carrying member; and a second contact portion provided on said supporting member and positioned downstream of said first contact portion with respect to the rotational moving direction.

According to a further aspect of the present invention, there is provided a process cartridge detachably mountable to a main assembly of an image forming apparatus, said process cartridge comprising an image bearing member for carrying an electrostatic latent image; a developer carrying member for carrying a developer for developing the electrostatic latent image; and a regulating member for regulating a developer amount carried on said developer carrying member; said regulating member including, a plate-like supporting member having an elasticity, said supporting member being provided with a fixed portion for being fixed to a fixed part, said supporting member has a free end disposed at an upstream side with respect to a rotational moving direction of said developer carrying member; a first contact portion provided on said supporting member and protruding toward said developer carrying member to contact to said developer carrying member; and a second contact portion provided on said supporting member and positioned downstream of said first contact portion with respect to the rotational moving direction.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described. The preferred embodiments of the present invention will be described in conjunction with the accompanying drawings. Here, the dimensions, the sizes, the materials, the configurations, the relative positional relationships of the elements in the following embodiments and examples are not restrictive to the present invention unless otherwise stated.

Embodiment 1

Figure 1:
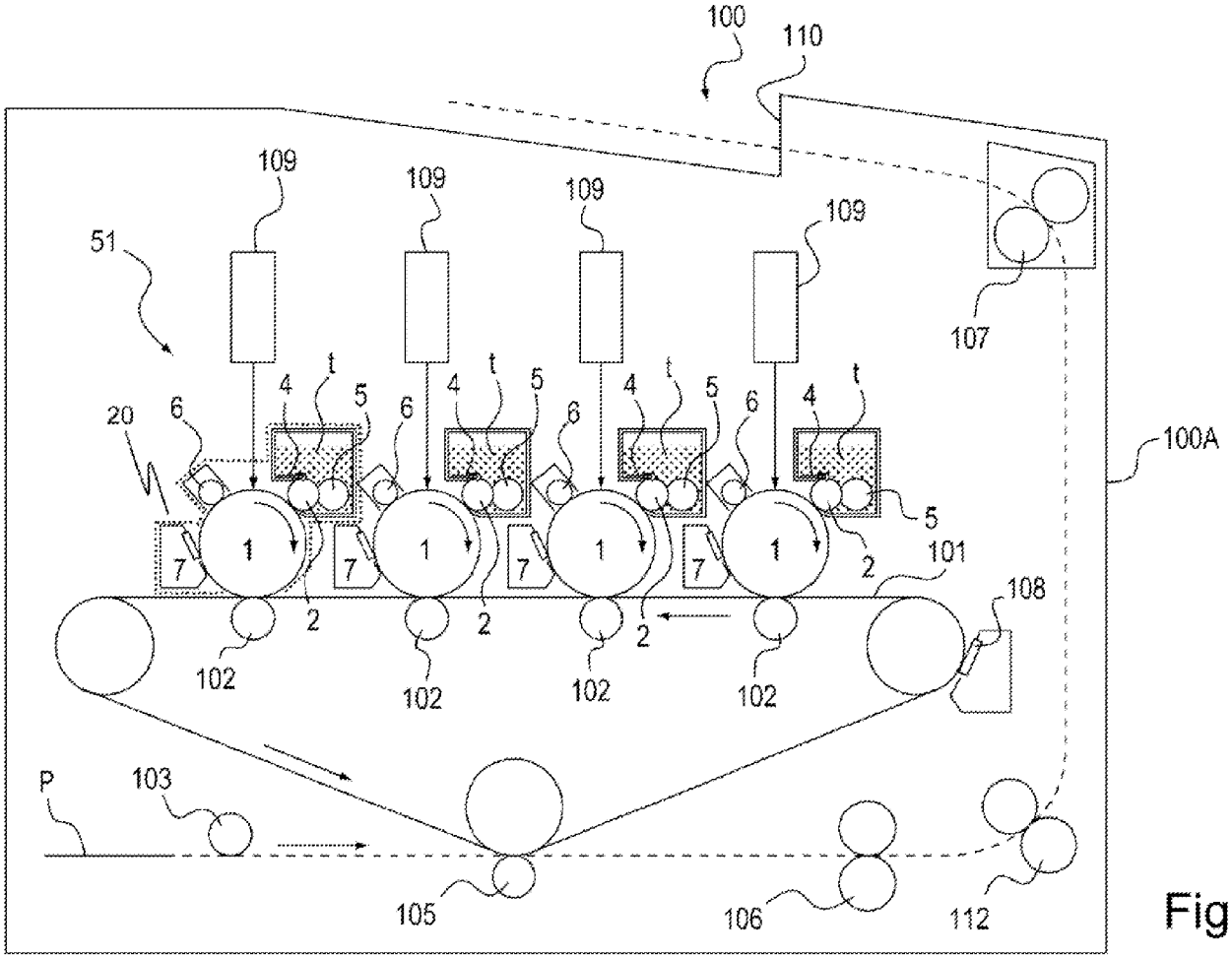
FIG. 1 is a sectional view illustrating a structure of an image forming apparatus provided with a developing device according to Embodiment 1 of the present invention.

FIG. 1 is a sectional view illustrating a structure of an image forming apparatus 100 comprising a developing device 10 according to Embodiment 1 of the present invention. Image forming apparatus 100 is a full-color laser beam printer of an in-line type and an intermediary transfer type, using an electrophotographic image forming process. As shown in FIG. 1, the image forming apparatus 100 comprises a main assembly 100A of the apparatus (main assembly of the image forming apparatus) and an image forming station 51 for forming images in the main assembly 100A. The image forming station 51 includes a photosensitive drum 1 as an image bearing member, a transfer roller 102 as a transferring device, and so on. At least the photosensitive drum 1 may be included in a process cartridge 20 which is detachably mountable to the main assembly 100A.

The main assembly 100A comprises a plurality of image forming stations for forming yellow (Y), magenta (M), cyan (C) and black (K) images, respectively. Electrostatic latent images formed on the respective photosensitive drums 1 (image bearing members) are developed with respective color toner t (developer) into visualized images. The image forming stations for different colors have substantially the same structures.

For formation of the electrostatic latent image on the photosensitive drum 1, a surface of the photosensitive drum 1 (peripheral surface) is uniformly charged by a charging roller 6 as a charging means to predetermined polarity and potential. The surface of the photosensitive drum 1 after the charging is exposed and scanned by a laser beam outputted from a laser beam scanner 109 as an exposure means, by which an electrostatic latent image corresponding to intended image is formed. The electrostatic latent image on the photosensitive drum 1 is developed into the toner image by the image forming station 51 as described hereinbefore.

The toner image formed on the photosensitive drum 1 is transferred by the transfer roller 102 onto an intermediary transfer belt 101 as an intermediary transfer member for transferring the toner image onto the recording material (recording material) P. The photosensitive drum 1 after the transfer is subjected to a cleaning operation of a cleaning device 108 as cleaning means press-contacted to the photosensitive drum 1 so that the remaining toner is removed to be prepared for the next image formation.

On the other hand, a recording material P is fed by a feeding roller 103 to a transfer nip between the intermediary transfer belt 101 and a transfer roller 105 in timed relation with the toner image (developed image) transferred onto the intermediary transfer belt 101, so that the toner image is transferred onto the recording material P. During the transfer operation, the transfer roller 105 is supplied with a transfer bias from a transfer bias application voltage source.

The recording material P now carrying the toner image is separated from the surface of the intermediary transfer belt 101, and is fed to a fixing device 107 as a fixing means by feeding rollers 106 and feeding rollers 112, and by the fixing device 107, it is subjected to heating and pressing so that the toner image is fixed on the surface of the recording material P. Thereafter, the recording material P is discharged to the outside of the main assembly 100A through a discharge opening 110 provided in the main assembly 100A. On the other hand, the intermediary transfer belt 101 after the transfer of the toner image is subjected to the cleaning operation of the cleaning device 108 as a cleaning means for the intermediary transfer belt 101 so that the toner remaining on the surface without being transferred to the recording material P is removed to be prepared for the next image formation.

In the image forming apparatus 100 of this embodiment, four process means, namely the photosensitive drum 1, the charging roller 6, the developing device 10 and the cleaning member 7 are contained integrally in a cartridge container. They constitutes a process cartridge (process unit) 20 detachably mountable to the main assembly 100A. The process cartridges for the different colors have the same structures and contain the yellow, magenta, cyan and black toner, respectively.

The apparatus described above is a full-color laser beam printer, and when it is a monochromatic laser beam printer, the process cartridge is a monochromatic one. The intermediary transfer member may not be used wherein the image is directly transferred onto the recording material P from the photosensitive drum 1.

Figure 2:
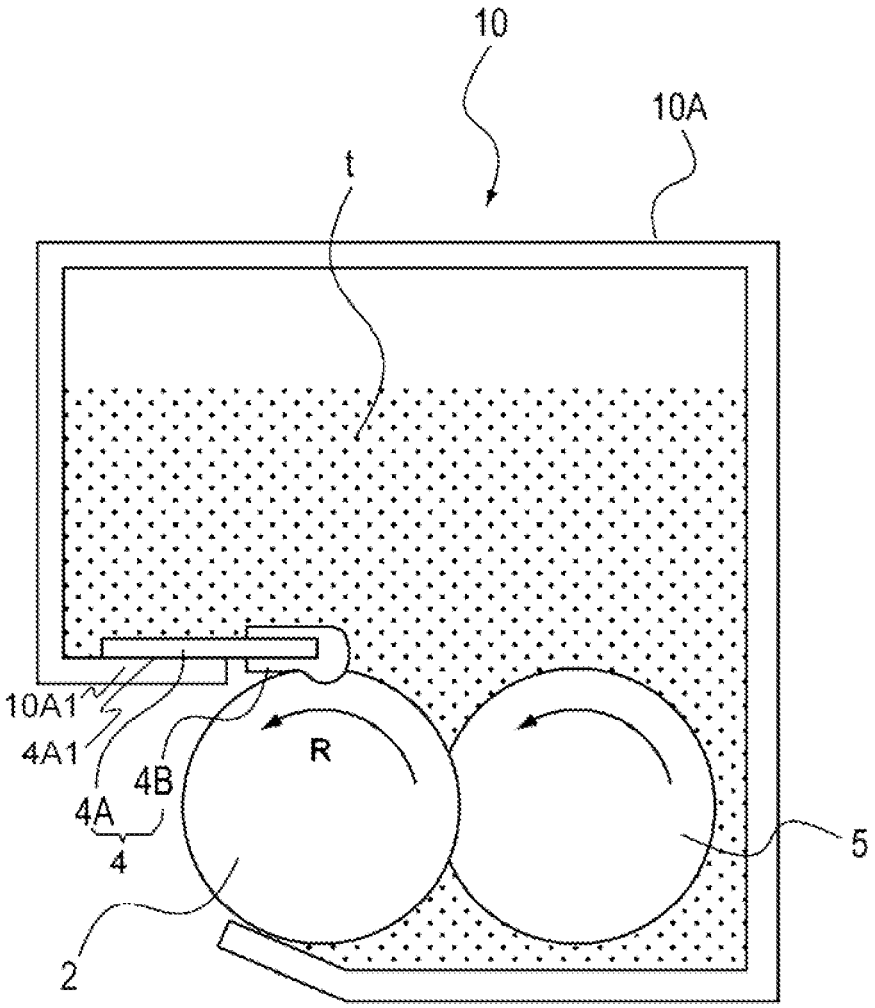
FIG. 2 is a sectional view illustrating a structure of the developing device.

FIG. 2 is a sectional view illustrating a structure of the developing device. The developing device 10 includes a developing container 10A. In the developing container 10A, there are provided a regulating member 4, a developing roller 2 and a supplying roller 5. The developing container 10A contains the toner particles t.

The supplying roller 5 is an elastic sponge roller comprising an electroconductive core metal and a foam member therearound. The supplying roller 5 is positioned so as to contact the developing roller 2 with a predetermined virtual bite depth, thus forming a predetermined nip between the developing roller 2. The supplying roller 5 rotates in the opposite peripheral moving direction relative to the developing roller 2 to supply the toner to the developing roller 2.

The developing roller 2 as a developer carrying member is a rubber roller comprising an electroconductive core metal and a rubber elastic member therearound and is effective to carry the toner t and to develop the electrostatic latent image formed on the photosensitive drum 1 with the toner. The developing roller 2 rotates so that the surface moves thereof moves in the same direction as the surface of the photosensitive drum 1 where they are opposed to each other. A predetermined bias is applied to the developing roller 2 to transfer the toner to the electrostatic latent image formed on the photosensitive drum 1, thus visualizing the electrostatic latent image.

The regulating member 4 will be described. The regulating member 4 is contacted to the developing roller 2 and is effective to optimize the toner amount on developing roller 2 and optimize the electric charge of the toner. The position of the free end of the regulating member 4 is set so that it would virtually enter or bite into the developing roller 2, but actually deforms by the abutment to the developing roller 2, and a pressing force is produced by the repelling force. The regulating member 4 has a two-layer-structure with the coating resin material layer 4B to constitute a so-called developing blade (regulating blade).

Figure 3:
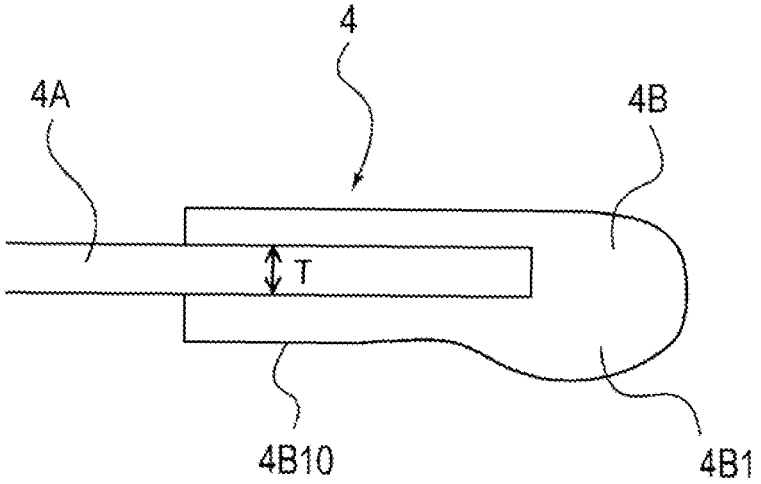
FIG. 3 is a sectional view illustrating a structure of a regulating member.
Figure 3:
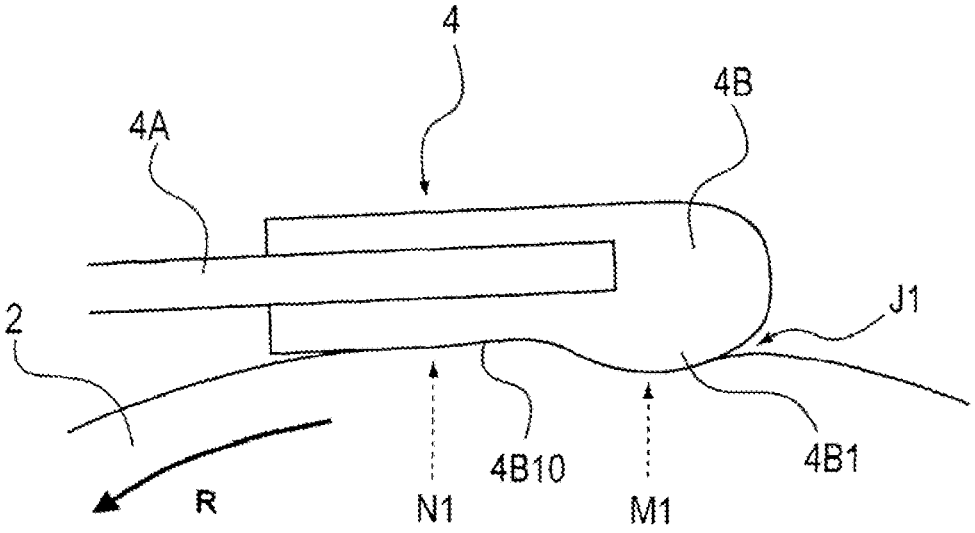

Part (a) of FIG. 3 is a sectional view illustrating a structure of the regulating member 4. As shown in part (a) of FIG. 3, the regulating member 4 regulates an amount of the toner t carried on the developing roller 2. The regulating member 4 comprises a supporting member 4A, and a resin material layer 4B mounted at a free end portion of the supporting member 4A. The resin material layer 4B has, at the free end portion, a projection 4B1 projecting toward the developing roller 2, and has, at a base end portion, a straight portion 4B10 having a flat surface.

The supporting member 4A is a plate-like elastic member. The supporting member 4A is made of a metal (stainless steel in this embodiment) thin plate to provide it with elasticity (spring property). However, in place of stainless steel, phosphor bronze, aluminum alloy or the like may be used, and may be high hardness resin material. The supporting member 4A is provided with a fixed portion 4A1 (FIG. 2) at the base end portion, and the fixed portion 4A1 is fixed to the fixed part 10A1 (FIG. 2) provided in the developing container 10A.

A free end portion of the supporting member 4A faces upstream with respect to a rotational moving direction R of the developing roller 2. That is, the regulating member 4 is counter-directional with respect to the rotation of the developing roller 2.

On the other hand, the resin material layer 4B comprises a supporting member 4A and a coating of polyurethane resin thereon. Other usable materials of the resin material layer 4B include polyamide, polyamide elastomer, polyester, polyester elastomer, polyester terephthalate, silicone rubber, silicon resin material or melamine resin material alone or in combination. If necessary, the material may contain various additives such as roughening particles. The coating layer may be a metal.

As for the formation of the resin material layer 4B, there are a coating method employed in this embodiment, a method of directly forming it on the supporting member 4A, a bonding method of bonding a prepared resin material layer 4B thereon. As for the method of directly forming the resin material layer 4B on the supporting member 4A, the source material is extruded on the supporting member 4A, or the source material is applied by dipping, coating, atomization or the like on the metal thin plate. As for the method of forming the resin material layer 4B, there are a method of cutting out of a sheet of the material, or a method of forming the resin material layer 4B using a metal mold or the like.

Part (b) of FIG. 3 is a sectional view showing a state in which the regulating member 4 contacts the developing roller 2. As shown in part (b) of FIG. 3, the regulating member 4 and the developing roller 2 form one continuous nip. Regulating member 4 has a fixed end at the base end portion, and the free end at the opposite portion, and the free end portion has a continuous curved surface.

As described above, the free end of the regulating member 4 is provided with a projection 4B1 by the resin material layer 4B1 provided on the supporting member 4A. The projection 4B1 is formed so as to project from one end portion (lower side of the supporting member 4A in part (a)

of FIG. 3) of the regulating member 4 toward the developing roller 2 with respect to a direction T of thickness of the supporting member 4A. The projection 4B1 contacts the developing roller 2, thus constituting a first contact portion.

Furthermore, the regulating member 4 is provided with a straight portion 4B10 (second contact portion) which is contacted with the developing roller 2 at a position closer to the base end portion (fixed portion) of the regulating member 4A than the projection 4B1.

In a distribution of the pressure received by the developing roller 2 from the regulating member 4 (distribution of the pressure applied by the regulating member 4 to the developing roller 2), there are a plurality of local maximum values along peripheral direction of rotation of the developing roller 2. More particularly, the local maximum value is formed at a position M1 where the developing roller 2 contacts a central portion of the projection 4B1 of the regulating member 4. Also, the local maximum value is formed at a portion (position N1) which is downstream of the position M1 with respect to the rotational moving direction of the developing roller 2 and which is the position where the developing roller 2 is deformed most within the region of contact between the developing roller 2 and the straight portion 4B10 of the regulating member 4. In this embodiment, of the plurality of local maximum values of the pressure, the upstreammost local maximum value with respect to the rotational moving direction of the developing roller 2 is the maximum. In this embodiment, therefore, the pressure received by the projection 4*b*1 of the regulating member 4 is the maximum. This will be described in detail.

Figure 4:
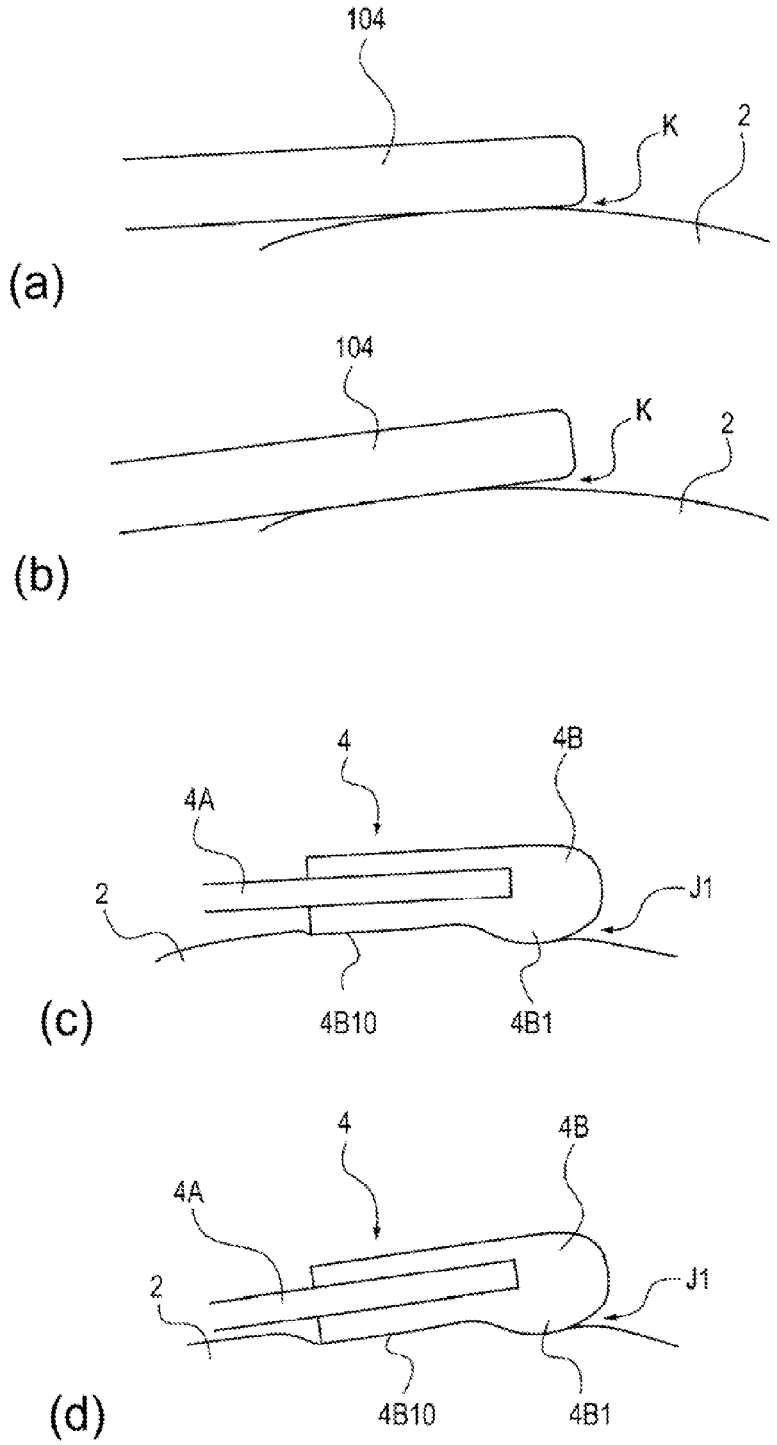
FIG. 4 is a sectional view and so on illustrating a state when a virtual bite depth of the regulating member of a comparison example into a-developing roller is small.

Referring to FIG. 4, the description will be made as to a change in the state of contact between the regulating member 4 and the developing roller 2 when the virtual bite depth of the regulating member 4 into the developing roller 2 are different. Part (a) of FIG. 4 is a sectional view illustrating a state in which the virtual bite depth of the regulating member 104 into the developing roller 2 is small in a comparison example. Part (b) of FIG. 4 is a sectional view illustrating a state in which the virtual bite depth of the regulating member 104 into the developing roller 2 is large in the comparison example. Part (c) of FIG. 4 is a sectional view illustrating a state in which the virtual bite depth of the regulating member 104 into the developing roller 2 is small in Embodiment 1. Part (d) of FIG. 4 is a sectional view illustrating a state in which the virtual bite depth of the regulating member 104 into the developing roller 2 is large in Embodiment 1.

The regulating member 104 of the comparison example corresponds to a conventional example, wherein it is a supporting member 4A which is substantially only a straight shape plate-like member.

As shown in parts (a)-(d) of FIG. 4, when the virtual bite depth of the regulating member 104 or regulating member 4 into the developing roller 2 changes, the situation is as follows. In the comparison example, the configuration and the size of the developer intake opening K change significantly. In Embodiment 1, the configuration and the size of the developer intake opening J1 of the regulating member 4 change only slightly. This is because the free end of the regulating member 4 forming the developer intake opening J1 is a curved surface. As compared with the developer intake opening K formed by the flat surface, the developer intake opening J1 formed by a curved surface less changes in the configuration and the size even when the virtual bite depth of the regulating member 4 into the developing roller 2 and/or the disposition of the regulating member 4 varies.

In this embodiment, even when the virtual bite depth of the regulating member 4 into the developing roller 2 changes as a whole by the variation of the disposition of the regulating member 4 relative to the developing roller 2, the change of the force pressing against the developing roller 2 by the free end portion of the regulating member 4 can be made less influential. This is because the base end portion (fixed end side) of the regulating member 4 absorbs the change of the pressing force. This will be described in detail.

The pressing force of the regulating member 4 relative to the developing roller 2 is positively correlated with the virtual bite depth of the regulating member 4 into the developing roller 2. Therefore, when the virtual bite depth of the regulating member 4 into the developing roller 2 changes due to the variation of the position of the regulating member 4 relative to the developing roller 2, for example, the pressing force of the regulating member 4 relative to developing roller 2 increases or decreases as a whole.

However, when the virtual bite depth of the regulating member 4 changes as a whole, the convex portion 4B1 at the free end portion of the regulating member 4 functions to reduce the change of the virtual bite depth. This is because the convex portion 4B1 provides a large pressing force relative to developing roller 2, and projects toward the developing roller 2, and therefore, the virtual depth of the biting into the developing roller 2 is large. On the contrary, the straight portion 4B10 which provides relatively small pressing force relative to the developing roller 2 than the convex portion 4B1 also virtual bite depth into the developing roller 2 is small, and the virtual bite depth change is large.

As a result, even if the pressing force of the regulating member 4 into the developing roller 2 changes as a whole, the change is absorbed by the straight portion 4B10, and therefore, the change in the convex portion 4B1 can be suppressed.

Particularly, in this embodiment, the straight portion 4B10 in the base end portion of the regulating member 4 changes the virtual bite depth relative to the developing roller 2 by increasing or decreasing the area of contact with the developing roller 2. By this, the straight portion 4B10 can absorb the variation mostly even in the case that the total amount of the pressing force of the regulating member 4 relative to the developing roller 2 changes. As a result, the convex portion 4B1 is effective to keep the small range of variation of the pressing force relative to the developing roller 2.

In summary, in the distribution of the pressing force (pressure) by the regulating member 4 to the developing roller 2, when there are a plurality of local maximum values of the pressing force (pressure), the maximum local maximum value (by the convex portion 4B1 in this embodiment) can suppress the variation.

Here, the amount of the toner (developer) carried on the developing roller 2 is substantially regulated by the local maximum value at the upstreammost portion with respect to the rotational moving direction of the developing roller 2, of or among the local maximum values of the pressure applied to the developing roller 2 by the regulating member 4. According to this embodiment with the above-described structures, a peak value of the pressing force applied to the developing roller 2 by the convex portion 4B1 at the free end portion of the regulating member 4, that is, in the upstream portion with respect to the rotational moving direction of the developing roller 2, is stabilized. As a result, the regulating member 4 can regulate stably the toner amount carried on the developing roller 2, by the convex portion 4B.

The experiments for confirming the function and effects of this embodiment will be described. The distribution of the pressing force of the regulating member 4 to the developing roller 2 is determined by nipping a strip between the regulating member 4 and the developing roller 2 and measuring a drawing force required when the sheet is pulled out. In this embodiment, the sheet is nipped at the position where the pressing force of the regulating member 4 is to be measured, and the sheet is pulled out in the longitudinal direction of the developing roller 2. As for the strip, a SUS304 sheet having a thickness of 20 μm and a width of 50 μm is used. For the measurement of the drawing pressure, a spring balance is used. In this embodiment, the strip was directly nipped between the regulating member 4 and the developing roller 2, but three of such sheets may be nipped, and only the middle one may be pulled out.

Figure 5:
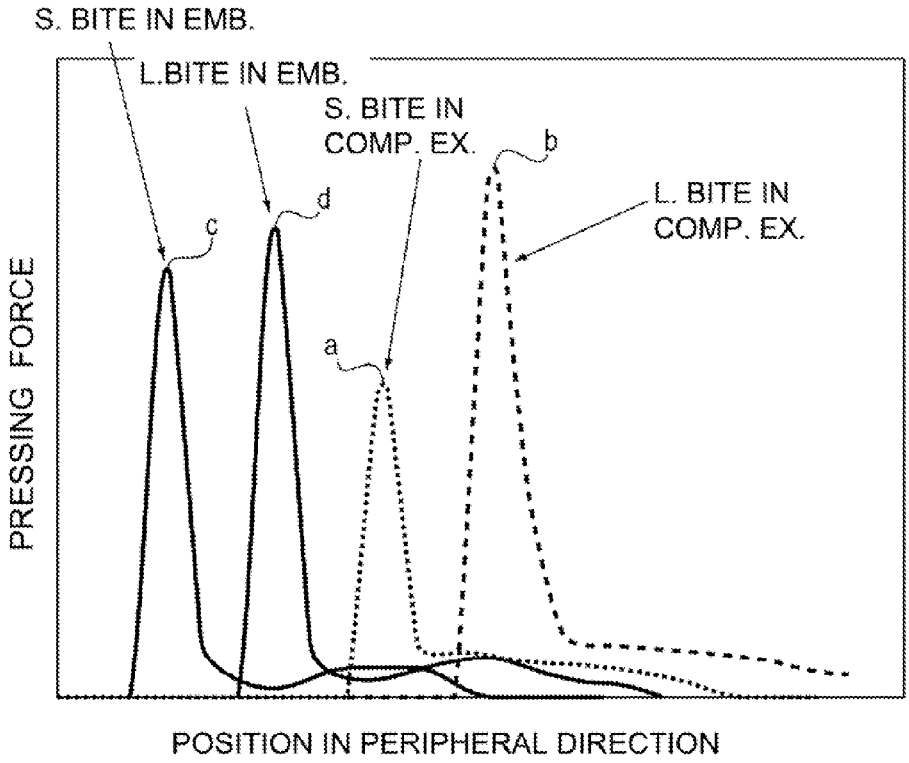
FIG. 5 is a graph of a peak value of a pressing force of the regulating member.

FIG. 5 is a graph of the peak value of the pressing force when the regulating member 4 of this embodiment and the regulating member 104 of the comparison example press the developing roller 2. This graph deals with the case in which the virtual bite depth of the regulating member into the developing roller 2 is large (large bite) and the case in which the virtual bite depth is small (small bite). In FIG. 5, solid lines indicate the distributions of the pressing force in the large bite case and the small bite case in this embodiment (regulating member 4). Broken lines indicate the distributions of the pressing force in the large bite case and the small bite case in the comparison example (regulating member 104).

In FIG. 5, the abscissa represents positions with respect to the circumferential direction (rotational moving direction) of the developing roller 2, and the data are shifted in the left and right direction for the purpose of easy comparison of the peak values. On the abscissa, the left side is the upstream side with respect to the rotational moving direction of the developing roller 2, and the righthand side is the downstream side. When the regulating member 4 of Embodiment 1 is used, the peak position of the pressing force is a position M1 in part (b) of FIG. 3, and as will be understood, the peak of the pressing force (local maximum value c and local maximum value d in FIG. 5) hardly changes even if the virtual bite depth changes. On the other hand, in the case of the conventional regulating member 104 shown in parts (a) and (b) of FIG. 4, the peak of the pressing force (local maximum value a and local maximum value b in FIG. 5) significantly changes when the virtual bite depth changes.

As will be understood from the foregoing, when the regulating member 4 is used, the intake configuration and the pressing force peak value can be made stable against the change in the virtual bite depth of the regulating member 4.

The description will be made as to the effects of this embodiment. In order to investigate the stabilization property of the amount of the developer layer (toner layer) relative to the virtual bite depth when the regulating member 4 of this embodiment is employed, the virtual bite depth of the regulating member 4 is changed, and the developer amounts are measured. As a comparison example, the same experiments are carried out using the conventional regulating member 104.

Figure 6:
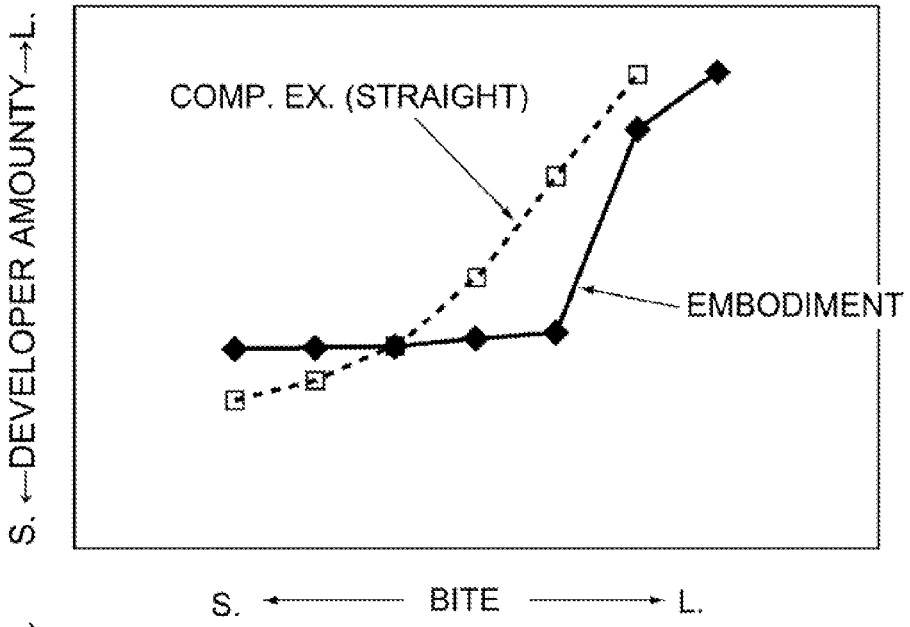
FIG. 6 is a graph and so on showing a relation between the developer amount and the virtual bite depth of the regulating member into the developing roller.

Part (a) of FIG. 6 is a graph showing a relationship between the virtual bite depth of the regulating member 4 into the developing roller 2 and developer amount in Embodiment 1 and the conventional example. As shown in part (a) of FIG. 6, in the range in which the virtual bite depth of the regulating member into the developing roller 2 is small, the change of the developer amount relative to the change of the virtual bite depth is less steep in the regulating member 4 of Embodiment 1 than in the regulating member 104 of the conventional example. On the other hand, in the range in which the virtual bite depth is large, the change of the developer amount significantly changes relative to the virtual bite depth both in the regulating members 4 and 104.

This is because the virtual bite depth is too large with the result that the regulating member 4 warps so that the peak value (free end part peak value) of the pressing force in the position M1 is smaller than the peak value pressing force (base end portion peak value) in the position N1 of the (b) of FIG. 3. In other words, the local maximum value position which determines the developer amount shifted from the free end portion of the nip to the nip base end portion local maximum value position, the free end of the regulating member 4 rises with the result of the change of the size of the developer intake opening J1, and therefore, the developer amount easily changes.

In this embodiment, the structure, disposition or the like of the regulating member 4 is determined such that even if the virtual bite depth of the regulating member 4 into the developing roller 2 becomes large, the local maximum value of the free end portion of the regulating member 4 keeps larger than the local maximum value of the base end portion.

Part (b) of FIG. 6 is a table showing occurrences of the density non-uniformity relative to then change in the outer diameter of the developing roller 2 in the cases of using the regulating member 4 of Embodiment 1 and the regulating member 104 of the comparison example. Using the regulating members 4 and 104, image forming operations were actually carried out. The virtual bite depth of the regulating member 4 at this time is so selected that the developer amount is stable. In order to check the effect against the density non-uniformity relative to the change of the outer diameter of the developing roller 2, developing rollers 2 having different unevennesses of the outer diameters are prepared, and the density non-uniformity distribution along the circumferential direction of the developing roller are assessed. The unevenness of the outer diameter is a difference between the maximum value of the diameter of the developing roller 2 and the minimum value when the diameters are measured while rotation the developing roller 2 by increment of 1°. When the difference is large, the density non-uniformity tends to occur because the change of the virtual bite depth of the regulating member 4 is large when the roller rotates.

The results of assessment are shown in part (b) of FIG. 6. When the regulating member 4 of Embodiment 1 is used, no density non-uniformity appears on the formed images even when the variation of the outer diameter of the developing roller 2 (the change of the outer diameter of the developing roller along the circumferential direction of the developing roller 2) is large. On the contrary, in the case that the regulating member 104 of the comparison example (straight shape) is used, a thin density non-uniformity appears when the variation of the outer diameter is about 40 μm, and when it is about 80 μm, a thick density non-uniformity appears.

From the foregoing, by contacting the regulating member 4 to the developing roller 2 such that the local maximum value of the pressure is in the free end side (upstream side with respect to the rotational moving direction of the developing roller 2), the stabilization property of the developer amount relative to the virtual bite depth is high. Therefore, by using the regulating member 4 of this embodiment, the developer intake opening J and/or the peak value of the pressing force is stabilized so that the density non-uniformity or the like is suppressed.

In summary, the pressure distribution applied to the developing roller 2 from the regulating member 4 is such that a plurality of local maximum values (two in this embodiment) are produced along the rotational moving direction of the developing roller 2. Furthermore, among the local maximum values, the upstreammost local maximum value with respect to the rotational moving direction of the developing roller 2 is the maximum. By doing so, even if the virtual bite depth of the regulating member 4 into the developing roller 2 changes with the result that the total amount of the pressing force applied to the developing roller 2 from the regulating member 4 varies, the influence of the variation of the pressing force to the maximum one of the local maximum values can be suppressed.

In other words, the virtual bite depth of the regulating member 4 into the developing roller 2 changes with the result that the total amount of the pressing force to the developing roller 2 from the regulating member 4 changes, the influence of the change to the maximum one of the local maximum values can be suppressed.

The developer amount carried on the developing roller 2 is regulated at the upstreammost point, with respect to the rotational moving direction of the developing roller 2, among the plurality of points of the local maximum values of the pressure to the developing roller 2 from the regulating member 4. As described above, the local maximum value of the pressure at the upstreammost position is the maximum among the plurality of local maximum values, and the variation of the pressure there is suppressed, and therefore, according to this embodiment, the regulating member 4 can stably regulate the developer carried on the developing roller 2.

Embodiment 2

Figure 7:
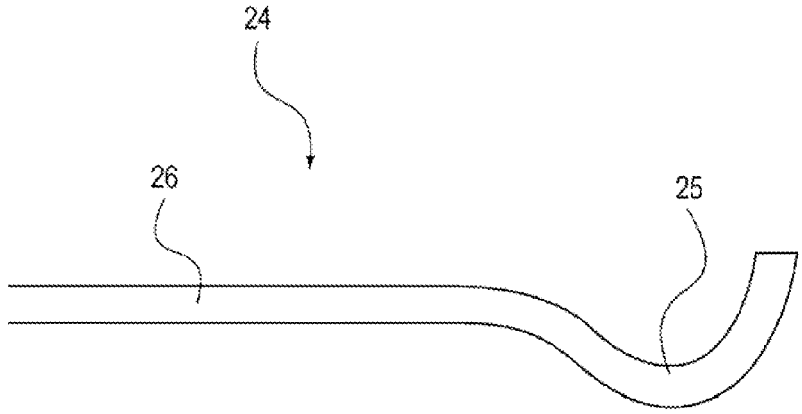
FIG. 7 is a sectional view illustrating a structure of the regulating member according to embodiment 2.
Figure 7:
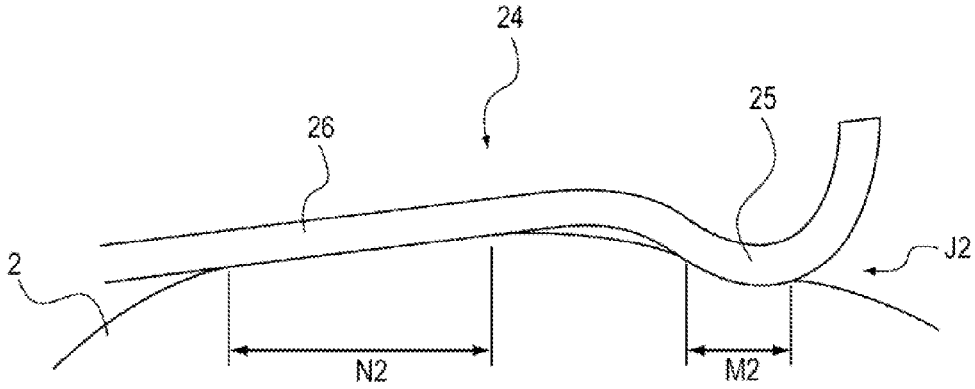

Part (a) of FIG. 7 is a sectional view illustrating a structure of a regulating member 24 according to Embodiment 2 of the present invention. Part (b) of FIG. 7 is a sectional view illustrating a structure of the regulating member 24 and a developing roller 2. In the description of this embodiment, the same reference numerals as in Embodiment 1 are assigned to the elements having the corresponding functions in this embodiment, and the detailed description thereof is omitted for simplicity.

The regulating member 24 is a thin plate of a metal similarly to the supporting member 4A (FIG. 3 or the like) in embodiment 1. In Embodiment 2, the regulating member 24 uses a supporting member without the resin material layer to provide the effects, as is different from embodiment 1. More particularly, the regulating member 24 is a supporting member having a curved free end portion to provide a convex portion 25 protruding toward the developing roller 2. A base end portion of the regulating member 24 is formed into a flat shape to provide a straight portion 26.

The convex portion 25 is a first contact portion of the regulating member 24 contacting the developing roller 2, and the straight portion 26 is a second contact portion. In this embodiment, a surface of the regulating member 24 which is the supporting member is the contact portion contacting the developing roller 2.

The regulating member 24 is made of a thin plate of a metal provided by press work. In this embodiment, the thin plate is made of a stainless steel, but phosphor bronze, aluminum alloy or the like is usable. The regulating member 24 is capable of providing the effect only by the supporting member, and therefore, does not have a resin material layer.

As shown in part (b) of FIG. 7, by the convex portion 25 of the regulating member 24 a nip (free end side nip M2) is formed between the developing roller 2 and the regulating member 24. In addition, by the straight portion 26 in the base end side of the regulating member 24 another nip (base end portion nip N2) is formed between the developing roller 2 and the regulating member 24. Thus, two nips are provided between the developing roller 2 and the regulating member 24. At this time, in a distribution of the pressing force by the regulating member 24 to the developing roller 2, there are local maximum values at the free end portion nip M2 and at the base end portion nip N2.

With such contact, even if a virtual bite depth changes due to the unevenness of the outer diameter of the developing roller 2 or change of the contact position of the regulating member 24, the size of the developer intake opening J2 does not change significantly because the free end portion of the regulating member 24 is the curved surface.

In addition, even if the virtual bite depth of the regulating member 24 into the developing roller 2 changes, the change of the pressing force can be reduced by the change of the nip width of the base end side nip. As a result, the peak value of the pressing force at the free end portion of the developing roller 2 is stabilized. From the foregoing, by employing the regulating member 24 of Embodiment 2, the intake configuration and the peak value of the pressing force can be stabilized against the change of the virtual bite depth of the regulating member 24.

The description will be made as to the effects of this embodiment. In order to investigate the stabilization property of the developer amount relative to the virtual bite depth when the regulating member 24 of this embodiment is employed, the developer amounts are measured while changing the virtual bite depth of the regulating member 24.

Figure 8:
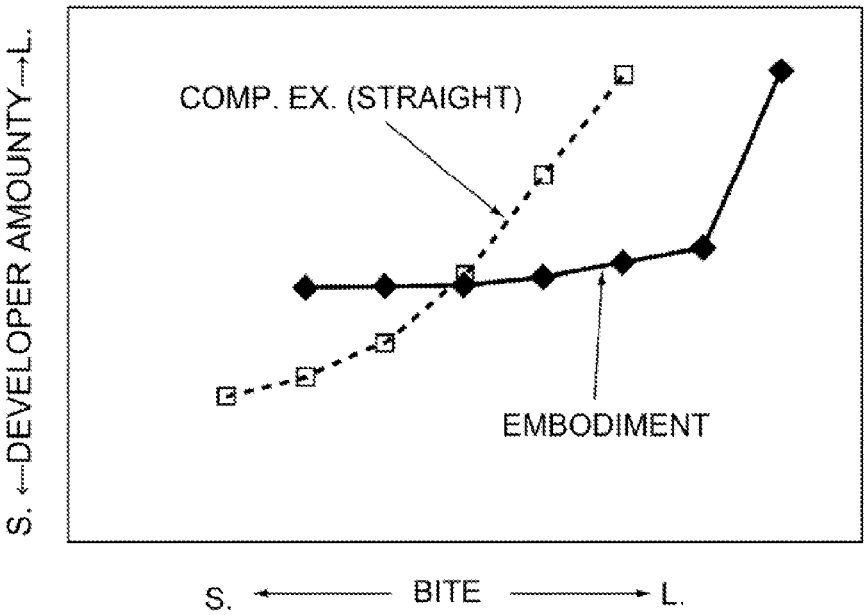
FIG. 8 is a graph showing a relation between the developer amount and the virtual bite depth of the regulating blade into the developing roller.

Part (a) of FIG. 8 is a graph of a relation between the virtual bite depths of the regulating members 24, 104 into the developing roller 2 and the developer amount. As will be understood from part (a) of FIG. 8, the change of the developer amount relative to the change of the virtual bite depth is less steep in the case of the regulating member 24 of Embodiment 2 than in the case of the regulating member 104.

Part (b) of FIG. 8 is a Table of results of experiments about the density non-uniformity relative to the variation of the outer diameter in Embodiment 2 and the comparison example. Using the regulating members 24, 104, image forming operations are actually carried out. In order to check the effect against the density non-uniformity relative to the change of the outer diameter of the developing roller 2, developing rollers 2 having different unevennesses of the outer diameters are prepared, and the density non-uniformity distribution along the circumferential direction of the developing roller are assessed.

When the regulating member 24 of Embodiment 2 is used, no density non-uniformity appears on the images even when the variation of the outer diameter of the developing roller 2 is large. On the contrary, in the case that the regulating member 104 of the comparison example (straight shape) is used, a thin density non-uniformity appears when the variation of the outer diameter is about 40 μm, and when it is about 80 μm, a thick density non-uniformity appears.

From the foregoing, it is understood that the stabilization property of the developer amount relative to the virtual bite depth of the regulating member 24 is high. Therefore, using the regulating member 24, the developer intake opening J2 and the peak value of the pressing force are stabilized, and the density non-uniformity or the like is suppressed.

Embodiment 2

Figure 9:
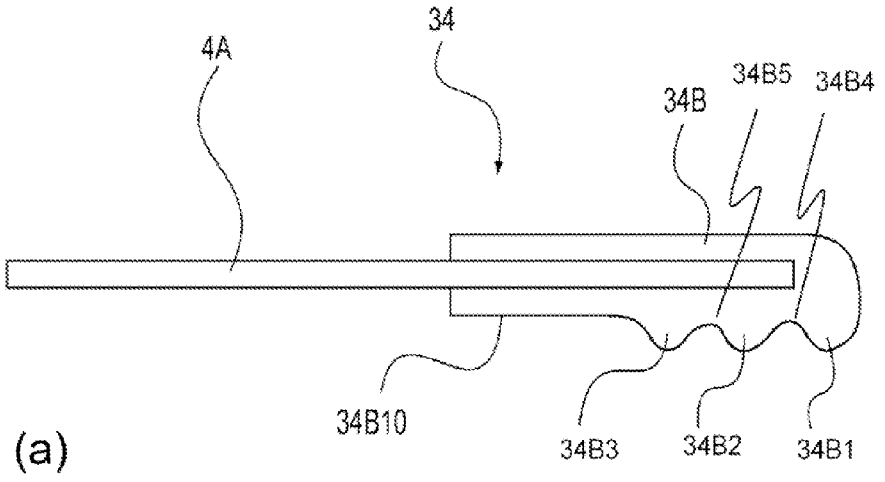
FIG. 9 is a sectional view illustrating a structure of the regulating member according to embodiment 2.
Figure 9:
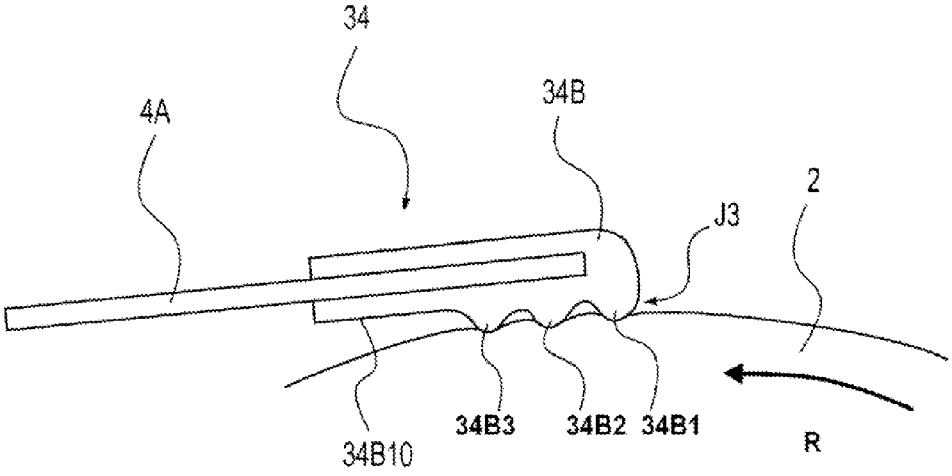
Figure 10:
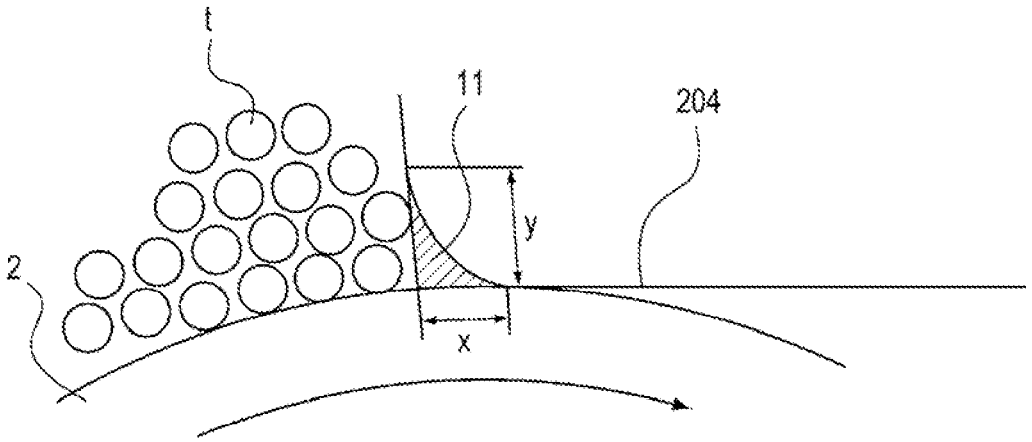
FIG. 10 is a sectional view illustrating structures of the regulating member and the developing roller according to prior art.

Part (a) of FIG. 9 is a sectional view illustrating a structure of a regulating member 34 according to Embodiment 3 of the present invention. Part (b) of FIG. 9 is a sectional view illustrating a structure of the regulating member 34 and a developing roller 2. In the description of this embodiment, the same reference numerals as in Embodiment 1 are assigned to the elements having the corresponding functions in this embodiment, and the detailed description thereof is omitted for simplicity. The regulating member 34 of Embodiment 3 is different from the regulating member 4 of Embodiment 1 in the following points.

The regulating member 34 of Embodiment 3 comprises a supporting member 4A and a resin material layer 34B mounted to a free end portion of the supporting member 4A. The resin material layer 34B comprises a plurality of convex portions 34B1, 34B2 and 34B3 projecting toward the developing roller 2 in the free end portion, and a straight portion 34B10 formed into a flat shape in the base end portion. The convex portion 34B1 is a first contact portion applying a maximum pressure to the developing roller 2 by contacting to the developing roller 2. The convex portions 34B2, 34B3 are second contact portions provided downstream of the convex portion 34B1 with respect to the rotational moving direction R of the developing roller 2. In this embodiment, as contrasted to the above-described embodiments, the second contact portion comprises a plurality of convex portions.

The supporting member 34A of the regulating member 34 shown in part (a) of FIG. 9 is made of thin plate of a metal, and the resin material layer 34B thereof is applied on the thin plate. The regulating member 34 is provided with the juxtaposed convex portions 34B1, 34B2, and 34B3. A recess is formed between the convex portion 34B1 and the convex portion 34B2, and a recess is formed between the convex portion 34B2 and the convex portion 34B3 to provide a recess 34B4 and a recess 34B5 with the regulating member 34.

The metal of the supporting member 34A is a stainless steel. It may be phosphor bronze, aluminum alloy or the like. The resin material layer 34B is a polyurethane coating. Other usable materials of the resin material layer 34B include polyamide, polyamide elastomer, polyester, polyester elastomer, polyester terephthalate, silicone rubber, silicon resin material, melamine resin material alone or in combination. If necessary, the material may contain various additives such as roughening particles.

As for the formation of the resin material layer 34B, there are a coating method employed in this embodiment, a method of directly forming it on the thin metal plate, a bonding method of bonding a prepared resin material layer 34B thereon. As for the method of directly forming the resin material layer 34B on the thin metal plate, the source material is extruded on the metal plate, or the source material is applied by dipping, coating, atomization or the like on the metal thin plate. As for the method of forming the resin material layer 34B, there are a method of cutting out of a sheet of the material, or a method of forming the resin material layer 34B using a metal mold or the like.

As shown in part (b) of FIG. 9, three nips are formed between the regulating member 4 and the developing roller 2, and the virtual bite depth in the free end portion is the maximum. By this, the pressing force is maximum at the upstreammost side.

With such contact, even if a virtual bite depth changes due to the unevenness of the outer diameter of the developing roller 2 or change of the contact position of the regulating member 34, the size of the developer intake opening J3 does not change significantly because the free end portion of the regulating member 34 is the curved surface.

In addition, even if the virtual bite depth of the regulating member 34 into the developing roller 2 changes, the change of the pressing force can be reduced by the change of the nip width of the base end side nip. As a result, the peak value of the pressing force at the free end portion of the developing roller 2 is stabilized. From the foregoing, by employing the regulating member 34, the intake configuration and the peak value of the pressing force can be stabilized even when the virtual bite depth of the regulating member 34 changes.

Similarly to Embodiments 1 and 2, the stabilization property of the developer amount was checked, and the results were that the stabilization property is high against the variation of the virtual bite depth as in Embodiments 1 and 2. From the foregoing, it has been confirmed that the stabilization property of the developer layer can be improved also when regulating member 34 is provided with three or more convex portions and therefore a plurality of local maximum values of the pressing force.

Therefore, when the plurality of local maximum values of the pressing force are provided by the recesses and projections formed on the surface of the, the developer intake opening J3 and/or the peak value of the pressing force is stabilized, and the occurrence of the density non-uniformity or the like can be suppressed regulating member 34.

It is preferable that the resin material layer 34B is provided with three or more convex portions as in this embodiment, but this is not inevitable. It will suffice if at least one convex portion as the second contact portion is provided at a position downstream of the convex portion 34B1 formed in the free end side of the regulating member 34 with respect to the rotational moving direction of the developing roller 2. Then, a plurality of local maximum values of the pressing force of the regulating member 34 to the developing roller 2 can be provided.

Embodiments 1-3 provide the following effects. Even when the outer diameter of the developing roller 2 is not uniform with the result of variation of the free end position of the regulating member 4, 24, 34, the size of the developer intake opening J1, J2, J3 between the regulating member 4, 24, 34 and the developing roller 2, and the peak value of the pressing force of the regulating member 4, 24, 34 to the developing roller 2 is stabilized. As a result, the developer amount carried on developing roller 2 is stabilized.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 116867/2011 and 093539/2012 filed May 25, 2011 and Apr. 17, 2012 which are hereby incorporated by reference.

What is claimed is:

1. A developing device for an image forming apparatus, said developing device comprising:

a developing roller including a surface for carrying developer; and a regulating member for regulating the developer carried on said surface of said developing roller, said regulating member including a plate-like metal portion and a resin portion provided on said metal portion, wherein said metal portion includes a facing surface facing said developing roller and a non-facing surface opposite from said facing surface, with said resin portion being provided on both of said facing surface and said non-facing surface, and with said metal portion being provided between a part of said resin portion contacting said developing roller and a part of said resin portion provided on said non-facing surface along a line perpendicular to said surface of said developing roller, and wherein, in a contact region between said developing roller and said regulating member, said resin portion on said facing surface is thicker than said resin portion on said non-facing surface.

2. A developing device according to claim 1, wherein, when said developing device takes a position that is taken when used in the image forming apparatus, a fixed end of said regulating member is more outside with respect to a horizontal direction than an outer peripheral surface of said developing roller.

3. An image forming apparatus comprising:

a belt member;

a plurality of photosensitive drums arranged along said belt member;

developing devices provided to correspond to said photosensitive drums respectively, said developing devices each including:

a developing roller including a surface for carrying developer; and a regulating member for regulating the developer carried on said surface of said developing roller, said regulating member including a metal portion and a resin portion provided on said metal portion, wherein said metal portion includes a facing surface facing said developing roller and a non-facing surface opposite from said facing surface, with said resin portion being provided on both of said facing surface and said non-facing surface, and with said metal portion being provided between a part of said resin portion contacting said developing roller and a part of said resin portion provided on said non-facing surface along a line perpendicular to said surface of said developing roller, and wherein, in a contact region between said developing roller and said regulating member, said resin portion on said facing surface is thicker than said resin portion on said non-facing surface.

4. An apparatus according to claim 3, wherein a fixed end of said regulating member is more outside with respect to a horizontal direction than an outer peripheral surface of said developing roller.

5. An apparatus according to claim 4, wherein each of said photosensitive drums is on a line vertically extending down from a fixed end of one of said regulating members.

6. A developing device for an image forming apparatus, said developing device comprising:

a developing roller including a surface for carrying developer; and a regulating member for regulating the developer carried on said surface of said developing roller, said regulating member including a plate-like metal portion, wherein said metal portion includes a facing surface facing said developing roller and a non-facing surface opposite from said facing surface, wherein said metal portion is provided between one portion and another portion along a line perpendicular to said surface of said developing roller, said one portion is formed so as to be provided on said facing surface and to contact said developing roller, and said another portion is formed so as to be provided on said non-facing surface, and wherein, in a contact region between said developing roller and said regulating member, said one portion is thicker than said another portion along the line perpendicular to said surface of said developing roller.

7. A developing device according to claim 6, wherein, when said developing device takes a position that is taken when used in the image forming apparatus, a fixed end of said regulating member is more outside with respect to a horizontal direction than an outer peripheral surface of said developing roller.

8. An image forming apparatus comprising:

a belt member;

a plurality of photosensitive drums arranged along said belt member;

developing devices provided to correspond to said photosensitive drums respectively, said developing devices each including:

a developing roller including a surface for carrying developer; and a regulating member for regulating the developer carried on said surface of said developing roller, said regulating member including a metal portion, wherein said metal portion includes a facing surface facing said developing roller and a non-facing surface opposite from said facing surface, wherein said metal portion is provided between one portion and another portion along a line perpendicular to said surface of said developing roller, said one portion is formed so as to be provided on said facing surface and to contact said developing roller, and said another portion is formed so as to be provided on said non-facing surface, and wherein, in a contact region between said developing roller and said regulating member, said one portion is thicker than said another portion along the line perpendicular to said surface of said developing roller.

9. An apparatus according to claim 8, wherein a fixed end of said regulating member is more outside with respect to a horizontal direction than an outer peripheral surface of said developing roller.

10. An apparatus according to claim 9, wherein each of said photosensitive drums is on a line vertically extending down from a fixed end of one of said regulating members.

* * * * *